US006173629B1

(12) United States Patent
Glaser

(10) Patent No.: US 6,173,629 B1
(45) Date of Patent: Jan. 16, 2001

(54) POWER OPERATED HOLDER AND ACTUATOR FOR PIVOTED DUAL-LEG TOOLS

(75) Inventor: Donald J. Glaser, Emporia, KS (US)

(73) Assignee: Glendo Corporation, Emporia, KS (US)

( * ) Notice: Under 35 U.S.C. 154(b), the term of this patent shall be extended for 0 days.

(21) Appl. No.: 09/252,946

(22) Filed: Feb. 18, 1999

(51) Int. Cl.[7] ..... B25H 3/00
(52) U.S. Cl. ..... 81/487; 269/96
(58) Field of Search ..... 269/96, 25; 254/10.5; 29/227; 81/301, 484, 487, 488

(56) References Cited

U.S. PATENT DOCUMENTS 3,741,562 * 6/1973 Resch ..... 269/96
3,888,003 * 6/1975 Brown ..... 81/301 X
4,105,188 * 8/1978 Mendoza et al. ..... 254/10.5
4,363,476 * 12/1982 Whittle ..... 269/96
4,442,581 * 4/1984 Molnick ..... 81/301 X

OTHER PUBLICATIONS

Techni–Tool Catalog 44, p. 62 (1993).
Catalog; Simonds Ergonomic Power Tools, p. 3 Date Unknown.

* cited by examiner

*Primary Examiner*—James G. Smith
(74) *Attorney, Agent, or Firm*—Hovey, Williams, Timmons & Collins

(57) ABSTRACT

An improved power operated tool holder and actuator unit (10) is provided which permits use of conventional, manually operable pivoted dual-leg tools (e.g., pliers, nippers or crimpers) and eliminates the need for specialized tools of this character. The unit (10) includes a tool holder (20) operably coupled with an actuator (18) which can be controlled by a foot switch (14). The holder (20) has upper and lower tool leg clamps (78, 82) which respectively hold the ends (178, 180) of a dual-leg tool (172). The lower leg clamp (82) is coupled via an operator (80) to a pneumatic piston and cylinder assembly (30) controlled by switch (14). In use, a charge of pressurized air delivered to the assembly (30) effects movement of a piston rod (40) which in turn moves leg clamp (82) so as to close the work performing ends (182, 184) of the tool (172).

13 Claims, 5 Drawing Sheets

154
64
72
156
86a
104a
148
68
152
126
84
132
118
136
134
164
70
32
58
54
56
60
62
26
30
52
162
42a
50
66
76
86
96
88
90
110
80
38
100
98b
98a
108
106
44
40
34
102
104
78
178
98
82
128
138
180
144
130
142
48
42
36
24
28

184
182
172
174
176
22
26
28
78
74
76
102
108
82
142
68
70
30
36
24
4.
4.
104
128
130
80
100
72
98
138
144
48
106
110
74
86
178
114
180
66
68
42
34
20
64

POWER OPERATED HOLDER AND ACTUATOR FOR PIVOTED DUAL-LEG TOOLS

BACKGROUND OF THE INVENTION

1. Field of the Invention

The present invention is broadly concerned with power operated holder and actuator units for supporting and actuating of variety of conventional manually operable pivoted dual-leg tools such as pliers, crimpers, bolt cutters or nippers. More particularly, the invention pertains to such a holder and actuator unit which preferably includes a pneumatically operated piston and cylinder actuator together with a tool holder releasably attached to the actuator and which can be readily modified to accommodate a variety of crossed-leg tools, as well as dual-leg tools of the toggle joint or pivoted compound joint type 2. Description of the Prior Art In many light manufacturing operations, workers are required to perform repetitive tasks using tools of various types. To give but one example, in jewelry manufacture, it is often necessary to remove waste sprues as a part of the manufacturing process. While each individual task of this type is generally not in itself difficult, experience has proved that over time workers may be injured by many repetitions of the task. Such repetitive motion injuries can include carpal tunnel syndrome, a painful condition which may require surgery to correct.

It has been suggested in the past to provide specialized production units as a replacement for hand cutters, pliers or other conventional manual tools. Generally speaking these prior production units are of highly specialized design and are expensive. Moreover, without known exception these units require the purchase and stocking of non-standard tool heads which are themselves very costly. While large manufacturing operations can justify the expense of prior production units of this type, they are often too costly for small manufacturing concerns.

There is accordingly a need in the art for improved, low cost power operated tool holder and actuator units which can accommodate low cost manual tools readily available from many sources and which have the necessary degree of operational flexibility allowing their use in many different types of businesses.

SUMMARY OF THE INVENTION

The present invention overcomes the problems outlined above, and provides a power operated tool holder and actuator for supporting and actuating manually operable pivoted dual-leg tools of conventional design. These tools broadly have a pair of pivotally joined legs, with each of the legs having a manual manipulation end and an opposed work performing end. Broadly speaking, the holder and actuator units of the invention include a holder operable to receive and hold the manipulating ends of a pivoted dual-leg tool so that the tool is located to receive and then perform a selected work operation on a workpiece placed between the work performing ends of the tool legs. The holder is operably coupled with a power actuator in order to shift at least one of the manipulation ends of the tool toward the opposed manipulation end thereof, thereby performing the desired work operation.

Preferably, the holder includes first and second clamps for respectively receiving and holding the manipulating ends of the tool legs, with the power actuator connected to one of the clamps for shifting of the tool leg held thereby. The power actuator is normally a reciprocal mechanism engageable with one of the clamps, such as a pneumatic piston and cylinder assembly. Operation of the actuator is advantageously controlled by means of a foot switch, such as a pneumatic switch in the case of the preferred pneumatic piston and cylinder assembly.

The units of the invention find utility in a number of contexts, such as in the jewelry, eyeglass, electronics and other light manufacturing industries, and in other situations where repetitive motion operations are encountered.

DETAILED DESCRIPTION OF THE PREFERRED EMBODIMENT

Figure 1:
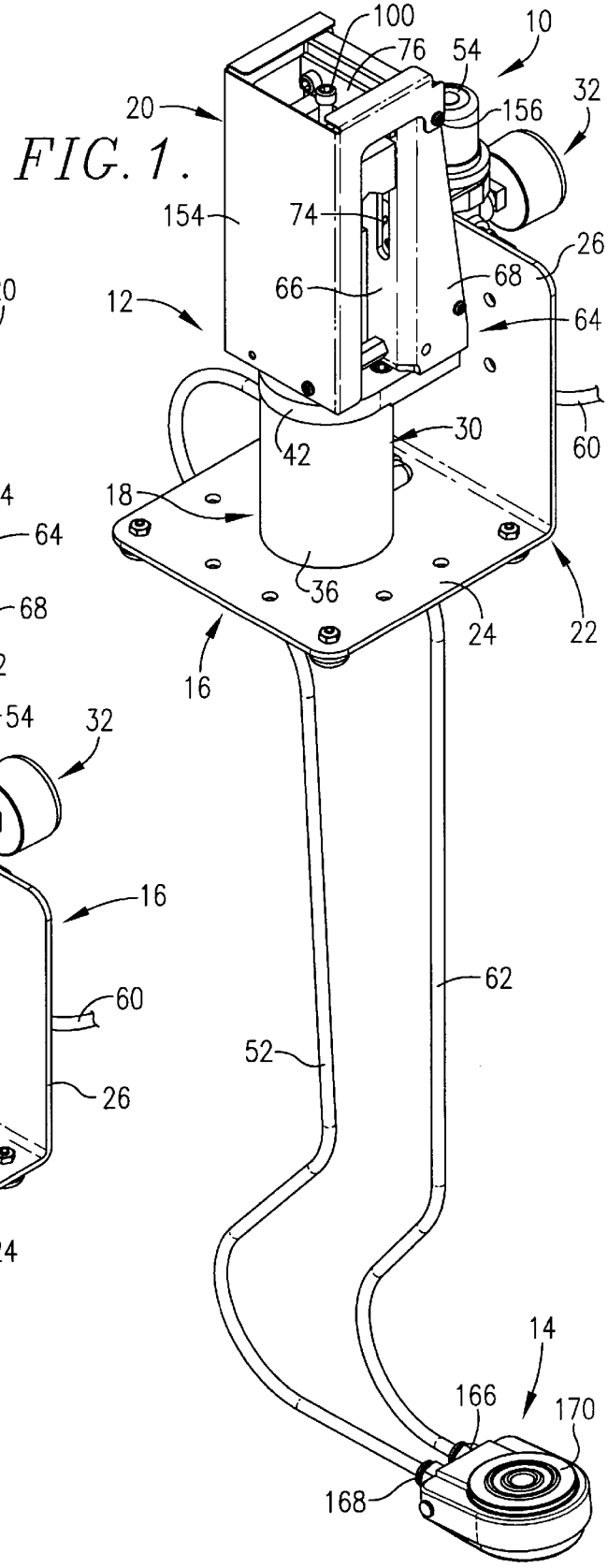
FIG. 1 is a perspective view of the preferred overall tool holder and actuator unit of the invention.
Figure 2:
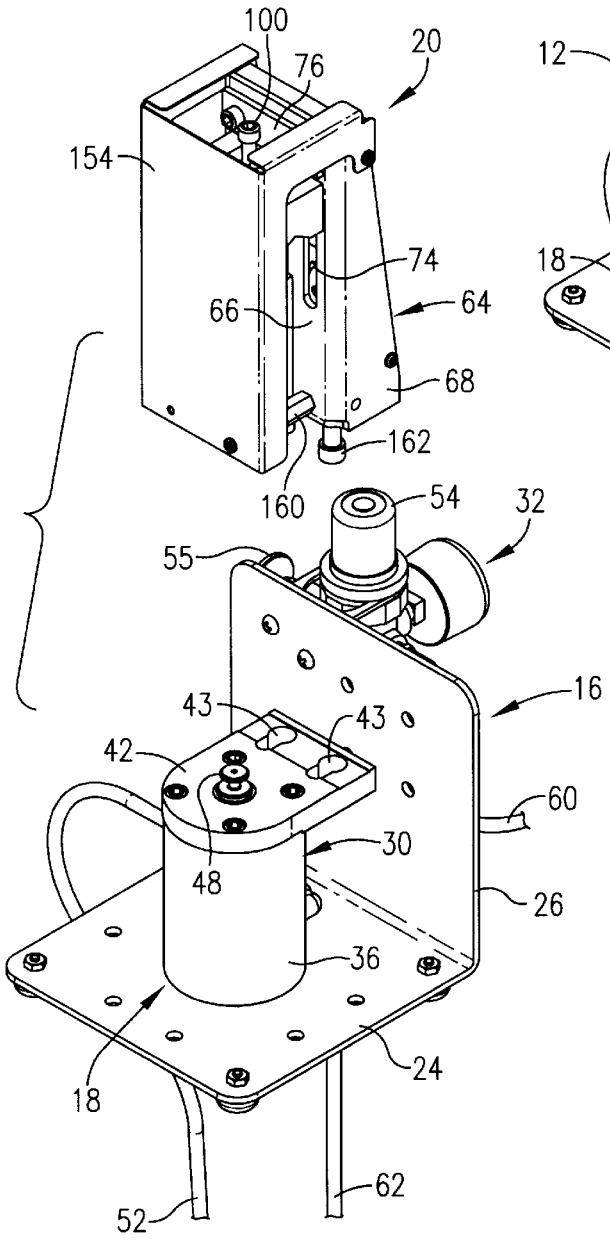
FIG. 2 is an exploded view illustrating the tool holding and actuating assembly of the overall unit equipped with a removable tool holder.

Turning now to the drawings and particularly FIGS. 1–2, a power operated holder and actuator unit 10 is illustrated. The unit 10 broadly includes a tool holding and actuating assembly 12 together with a foot operated, three-way actuating switch 14. The assembly 12 includes a frame 16 supporting a pneumatically operated actuator 18; a tool holder 20 is releasably secured to the actuator 18 and is adapted to hold any one of a number of conventional manually operable pivoted dual-leg tools.

Referring first to the components of tool holding and actuating assembly 12, it will be seen that the frame 16 is in the form of a unitary, metallic, generally L-shaped member 22 presenting a generally horizontally extending lower leg 24 and an upright sidewall 26. The lower leg 24 is equipped with comer-mounted pad-type feet 28 permitting the entire assembly 12 to rest upon a conventional work surface.

Figure 4:
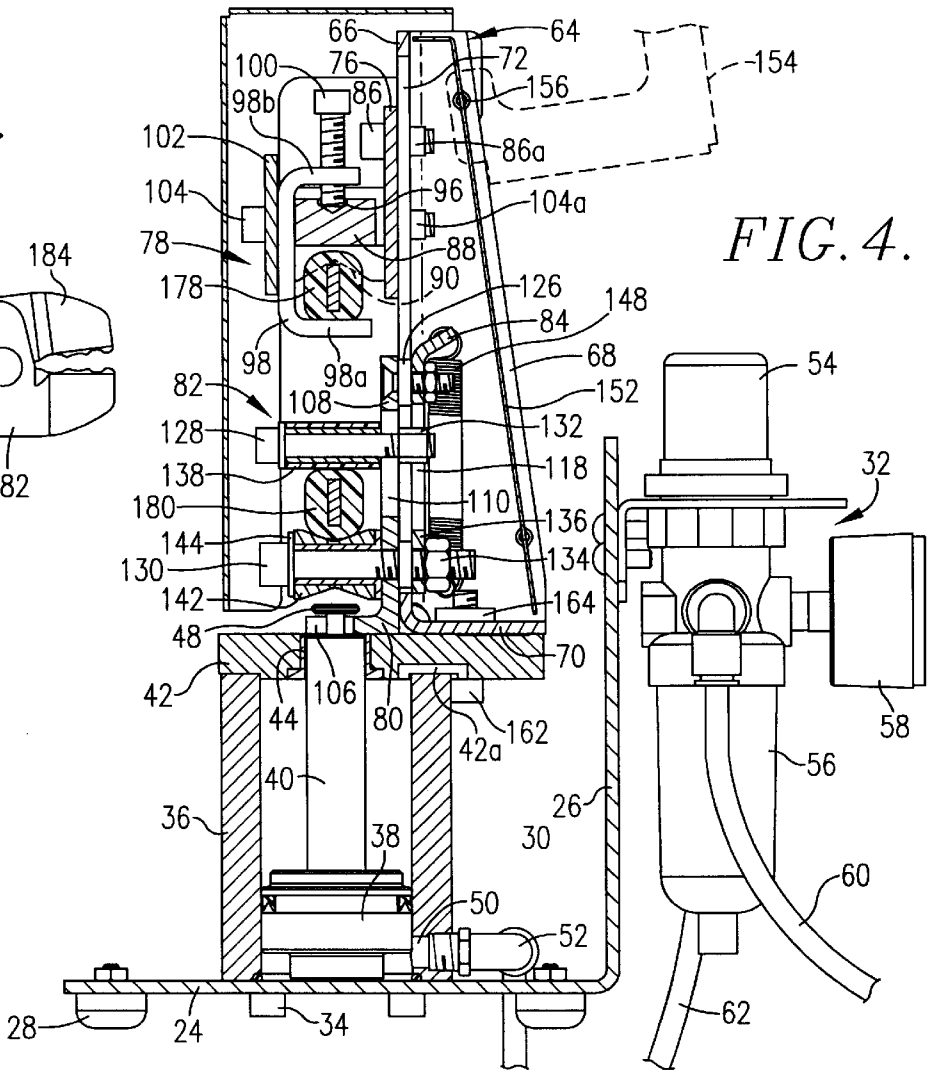
FIG. 4 is a vertical sectional view taken along line 4—4 of FIG. 3 and illustrating in detail the construction of the tool holding and actuating assembly.

The actuator 18 includes a single-acting, pneumatically operated piston and cylinder assembly 30 together with an associated regulator unit 32. As shown, the piston and cylinder assembly 30 is permanently affixed to lower leg 24 of frame member 22 via fasteners 34. The assembly 30 is of conventional construction and includes an upright, metalwalled, tubular chamber 36 housing a reciprocal piston 38 and an essentially vertically extending piston rod 40. As best illustrated in FIG. 4, the upper end of chamber 36 is closed by a laterally extending, apertured support plate 42, having a pair of keyhole openings 43 therethrough as well as a vent opening 42*a*. The plate 42 slidably and sealingly receives piston rod 40 during up and down reciprocation of piston 38. To this end, the plate 42 includes a bushing 46 defining an aperture 44 therein. It will be observed in this respect that the piston rod 40 includes an upstanding attachment button 48 which extends above the upper surface of plate 42, even in the lowermost position of piston 38 illustrated in FIG. 4. An air inlet port 50 is located adjacent the base of chamber 36 as shown, so as to permit threaded attachment of a pressurized actuated air line 52.

The regulator unit 32 is bolted to and supported by upright sidewall 26 of frame 16. The unit 32 is of conventional design and includes a regulator 54, needle valve 55, filter 56 and pressure gauge 58. A pressurized air inlet line 60 is coupled to regulator 54, and a regulated air output line 62 leads to one side of actuating switch 14. The previously described line 52 extends from the other side of switch 14 and is coupled to inlet port 50. It will be appreciated that introduction of pressurized air into the confines of chamber 36 beneath piston 38 will cause the latter to move upwardly, thereby extending piston rod 40.

Tool holder 20 is removably attached to support plate 42 and is operably coupled with piston rod 40 via attachment button 48. In particular, the tool holder 20 includes an upstanding primary plate 64 presenting a front wall 66, sidewalls 68 of somewhat truncated triangular configuration and bottom wall 70 having mounting holes 71 therethrough. The front wall 66 is provided with an elongated, centrally and vertically located main slot 72 together with a pair of secondary slots 74 respectively located on opposite sides of the primary slot.

The primary plate 64 supports on the forward face thereof an upper, generally T-shaped stop plate 76, an upper tool leg clamp 78, and a lower, generally L-shaped operator 80, the latter in turn supporting a lower tool leg clamp 82. A spring return plate 84 is also supported on the rear face of primary plate 64, and is coupled with operator 80 for up and down movement thereof in unison.

In particular, the stop plate 76 is fixedly but adjustably coupled to the front face of primary plate 64 by means of connecting bolts 86 and nuts 86a extending through appropriate openings in the plate 76 and through the side marginal slots 74. The plate 76 may be selectively adjusted upwardly or downwardly as desired and easily removable.

The upper tool leg clamp 78 includes a main block 88 presenting a recessed underside 90 adapted to engage a tool leg. The block 88 has a pair of transverse side mounting holes 92, a recessed upper face 94 with a bore 96 therein. A generally C-shaped coupler 98 is recessed in the forward face of block 88 and a screw 100 extends through the upper leg 98*b* of coupler 98 drilled into the upper face of coupler 98. It will be observed that the lower horizontal leg 98*a* of the coupler 98 is spaced below the longitudinally extending cutout in the underside 90 of block 88, so as to accommodate a tool leg (see FIG. 4). The upper tool clamp 78 is completed by means of a face plate 102 which engages the forward face of coupler 98 and the side margins of main block 88. A pair of mounting bolts 104 extend through the face plate 102, the holes 92 of block 88 and the slots 94 of primary plate 66, so as to hold the entire clamp 78 in place; side grooved nuts 104*a* complete this connection.

The operator 80 includes a lowermost, generally horizontal, bifurcated segment 106 designed to receive the upright shank of button 48 as best illustrated in FIG. 4. The upright segment 108 thereof has an elongated adjustment slot 110 as well as mounting holes 112 therethrough. The spring return plate 84 is mounted adjacent the opposite face of wall 66 of primary plate 74, and is coupled with the operator 80 for movement thereof in unison. In particular, it will be seen that the plate 84 is of somewhat T-shaped configuration presenting a pair of laterally extending, notched arms 114 and a depending section 116 having a central slot 118 and mounting holes 120.

In order to interconnect the operator 80 and plate 84, a bolt 122 extends through the upper mounting hole 112 of operator 80 and passes through primary slot 72 of plate 64 and through the corresponding upper mounting hole 120 of plate 84. A nut 124 completes this connection. In addition, an annular spacer 126 is supported by the shank of bolt 122 and this slides within the slot 72. Further connection between the operator 80 and plate 84 is provided by means of bolts 128, 130. As shown, the bolt 128 passes through slot 110 of operator 80, primary slot 72 of plate 64 and slot 118 of plate 84, with a square nut 132 completing the connection. The nut 132 is configured to slide within slot 72. Likewise, the bolt 130 passes through lower mounting hole 112 of operator 80, slot 72 and lower mounting hole 120 of plate 84, with nut 134 completing the connection. In this instance, an annular spacer 136 is supported by the shank of bolt 130 and slides within slot 72.

Figure 9:
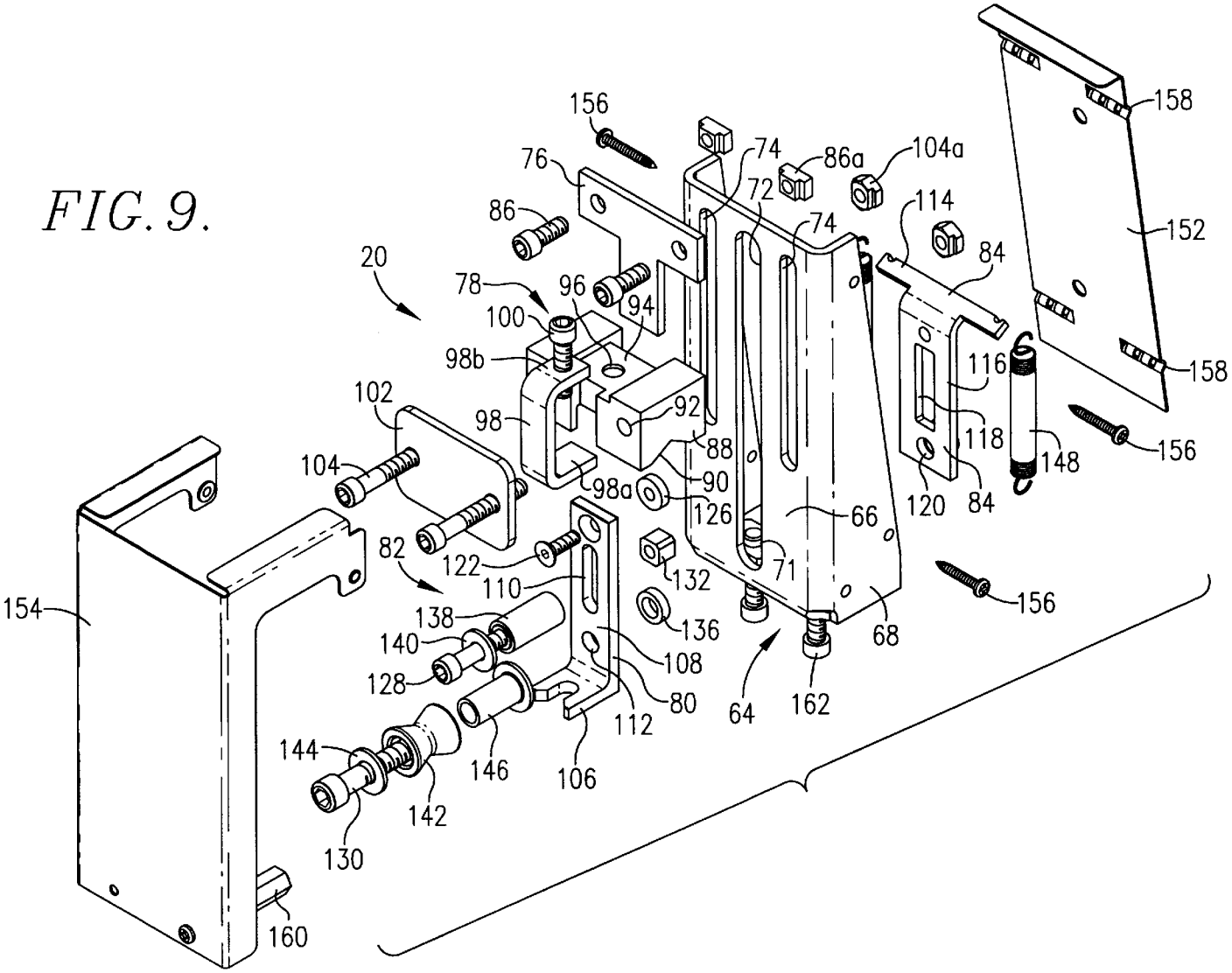
FIG. 9 is an exploded view depicting the components of the preferred tool holder.

As is evident from a consideration of FIGS. 4 and 9, the bolts 128, 130 also support the components of lower tool leg clamp 82. Specifically, the upper bolt 128 supports an upper roller 138, which is clamped between the forward face of operator 80 and a washer 140 also carried by the bolt 128. Similarly, a somewhat larger indented roller 142 is supported on lower bolt 130, with the roller 142 clamped between the forward face of operator 80 and a washer 144. As best seen in FIG. 9, the roller 142 is equipped with a separable metallic sleeve 146.

Figure 6:
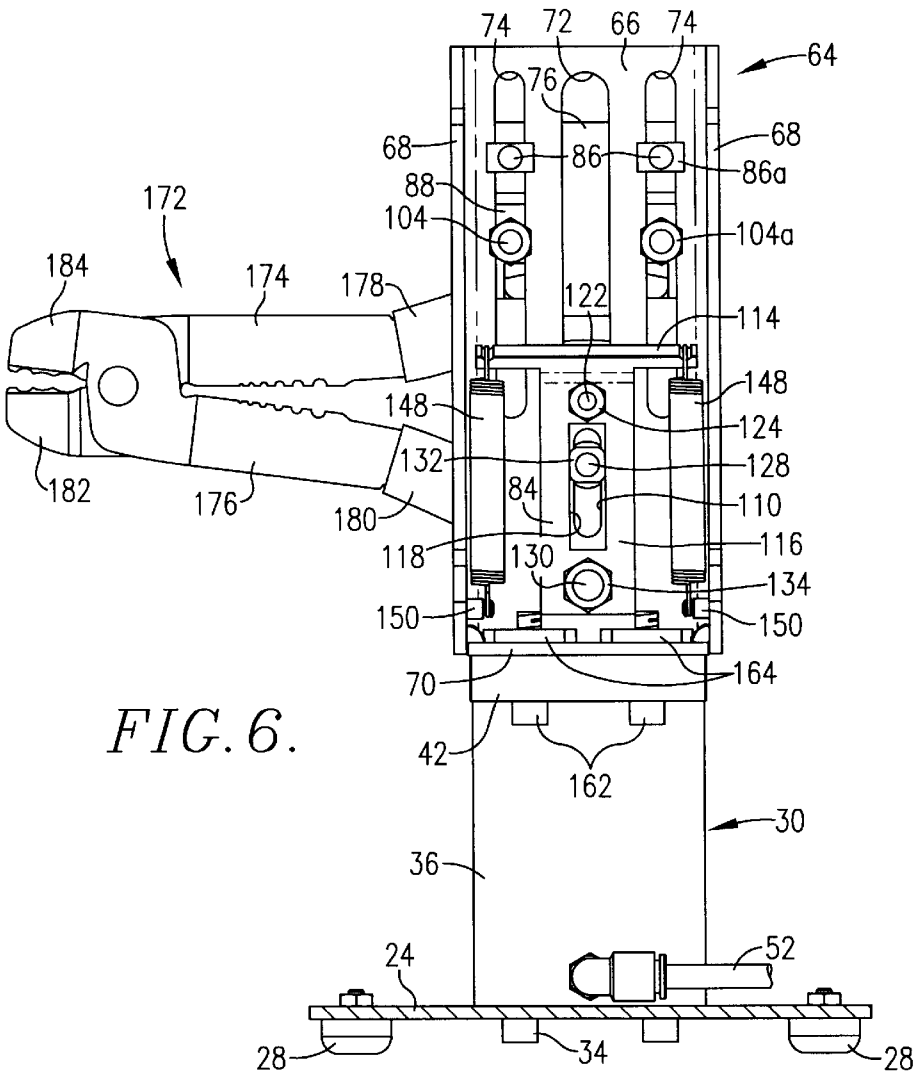
FIG. 6 is a rear elevational view of the tool holding and actuating assembly depicted in FIG. 3.

Referring now to FIGS. 6 and 9, it will be seen that a pair of helical return springs 148 are respectively connected between the notched ends of each of the legs 114 and lower stationary spring mounts 150, the latter being secured to the inner faces of the sidewalls 68 of plate 64.

The tool holder 20 is also preferably provided with a sectionalized safety cover, including a back cover plate 152 and a forward cover plate 154. Back plate 152 is releasably coupled to the sidewalls 68 of plate 64 by means of mounting screws 156 extending through appropriate openings in the sidewall 68 for receipt within screw notches 158 in the back plate. The forward plate 154 is pivotally coupled to the sidewall 68 and extends forwardly to cover the tool holding and operating structure supported on the forward face of the plate 64. A lower spacer 160 is secured to the bottom margin of forward plate 154 as indicated in order to insure proper positioning of the plate 154 in its down position.

The entire tool holder 20 is removably attached to plate 42 by means of bolts 162 extending through the keyhole slots 43 of plate 42 and mounting holes 71 of bottom wall 70 of plate 64. Upper plate-type nuts 164 complete this connection. It will be appreciated in this respect that when the tool holder 20 is properly positioned on plate 42, the bifurcated segment 106 of operator 80 receives and engages button 48 of piston rod 40.

The actuating switch 14 is of entirely conventional design and includes respective pneumatic ports 166, 168 adapted to receive the ends of air lines 52 and 62. It will be appreciated that depression of the pedal portion 170 of switch 14 permits delivery of a charge of pressurized air through line 52 to chamber 36 of piston and cylinder assembly 30, to thereby effect upward movement of the piston 38 and piston rod 40.

Operation

The unit 10 is designed to accommodate any one of a number of conventional pivoted dual-leg tools such as pliers, crimpers, nippers or cutoffs. Indeed, a principal advantage of the invention is that use can be made of standard, everyday tools designed for manual use, without any modification whatsoever of the tools. Thus, the need for purchasing and stocking of specialized tools usable only in conjunction with particular operating units is eliminated.

To this end, and considering the exemplary dual-leg tool 172 of the Figures, it will be observed that the tool has a pair of pivotally interconnected dual-legs 174, 176 each presenting a manual manipulation end 178, 180 and a work performing end 182, 184. The tool 172 is mounted within holder 20 by first making any necessary gross adjustments of the upper clamp 78. This involves loosening of the bolts 104 and appropriate vertical movement of the clamp 78 within the slots 74, whereupon the bolts 104 are retightened. Next, the screw 100 is loosened allowing the C-shaped coupler 98 to move freely relative to block 88, followed by loosening of bolt 128 allowing upper roller 138 to move vertically. The manipulation end 180 of leg 176 is then passed between the opposed rollers 138, 142, and the manipulation end 178 of leg 174 is passed between leg 98*a* and the recessed underside of block 88. At this point, the adjustable roller 138 is moved downwardly as necessary so as to captively retain the associated leg end 180, and screw 100 is tightened thereby drawing leg 98*a* against the end 178 of leg 174.

Figure 8:
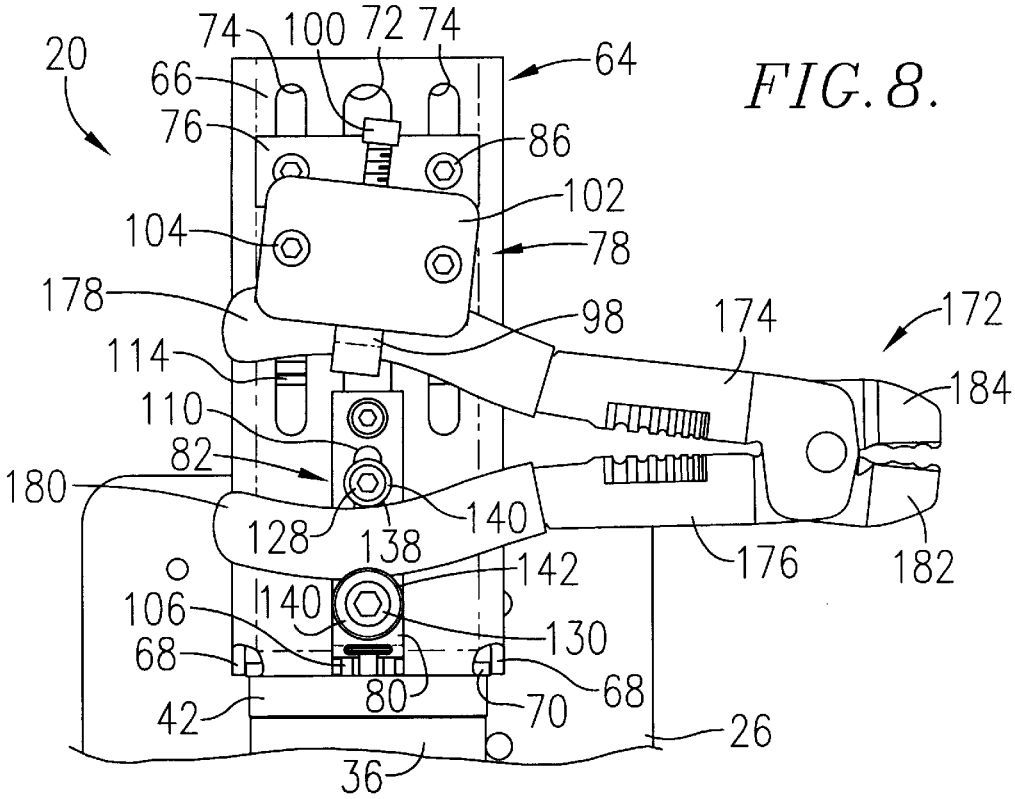
FIG. 8 is a fragmentary front view of the tool holding and actuating assembly illustrating adjustment of the upper tool clamp to a canted position so as to alter the orientation of the tool.
Figure 7:
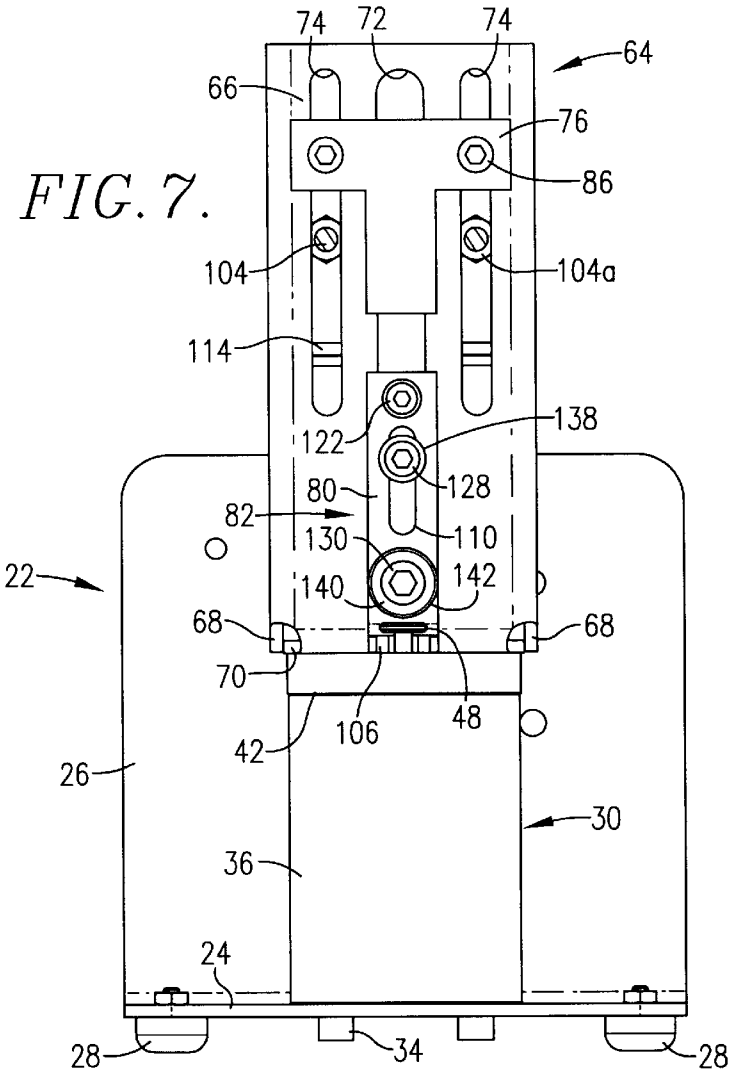
FIG. 7 is a front elevational view illustrating certain components of the tool holding and actuating assembly, but with the tool and upper tool clamp removed.

As depicted in FIG. 8, the upper clamp 78 can be angularly adjusted or canted so as to change the rest orientation of tool 172. This merely involves loosening of the bolts 104 and manual turning of the clamp 78 until the appropriate orientation is achieved, whereupon the bolts 104 are retightened.

Once the tool 172 is positioned within the holder 20, use can be made of the unit 10 for performing multiple work operations using the tool. Thus, a workpiece would typically be placed between the open jaws of the tool 172 and pedal portion 170 of switch 14 would be depressed by the operator's foot. This causes a charge of pressurized air to flow through the switch 14 from regulator unit 32 (which is controllable via needle valve 55) to piston and cylinder assembly 30 via line 52. Such pressurized air elevates piston 38 within chamber 36 (with air above piston 38 being vented through opening 42*a*) in order correspondingly extend piston rod 40 upwardly. As this occurs, the top surface of the piston engages the underside of segment 106 of operator 80, thereby elevating the operator along with spring return plate 84. This continues until the upper edge of the operator engages the lower edge of T-shaped stop plate 76, thereby is this instance limiting the stroke of the piston rod 40. It is also to be recognized that the stop plate 76 can be removed entirely, or moved upwardly to a point that it does not interfere with closure of the operating extremities of the held tool in which event closure of the tool itself acts as the stop thus ensuring full and complete tool closure. Furthermore, the stop plate 76 can be adjusted with the tool ends fully closed at a lower pressure which then prevents overstressing of the tool jaws when jaws are closed at a higher operating pressure.

As the operator 80 is elevated owing to extension of piston rod 40, the manipulation end 180 of tool leg 176 is moved upwardly so that the work performing end 184 thereof is pivoted towards the stationary work performing end 182 of leg 174. Thus, a work operation is performed on the workpiece located between the ends 182, 184 of the tool 172. It will be appreciated in this respect that the provision of rollers 138, 142 holding the manipulation end 180 allows appropriate movement of the latter during the work operation. Moreover, the provision of stop plate 76 allows precision work operations to be carried out, i.e., the stop can be located so as to prevent the work ends of the tool 172 from fully closing if a crimping operation or the like is desired.

Figure 3:
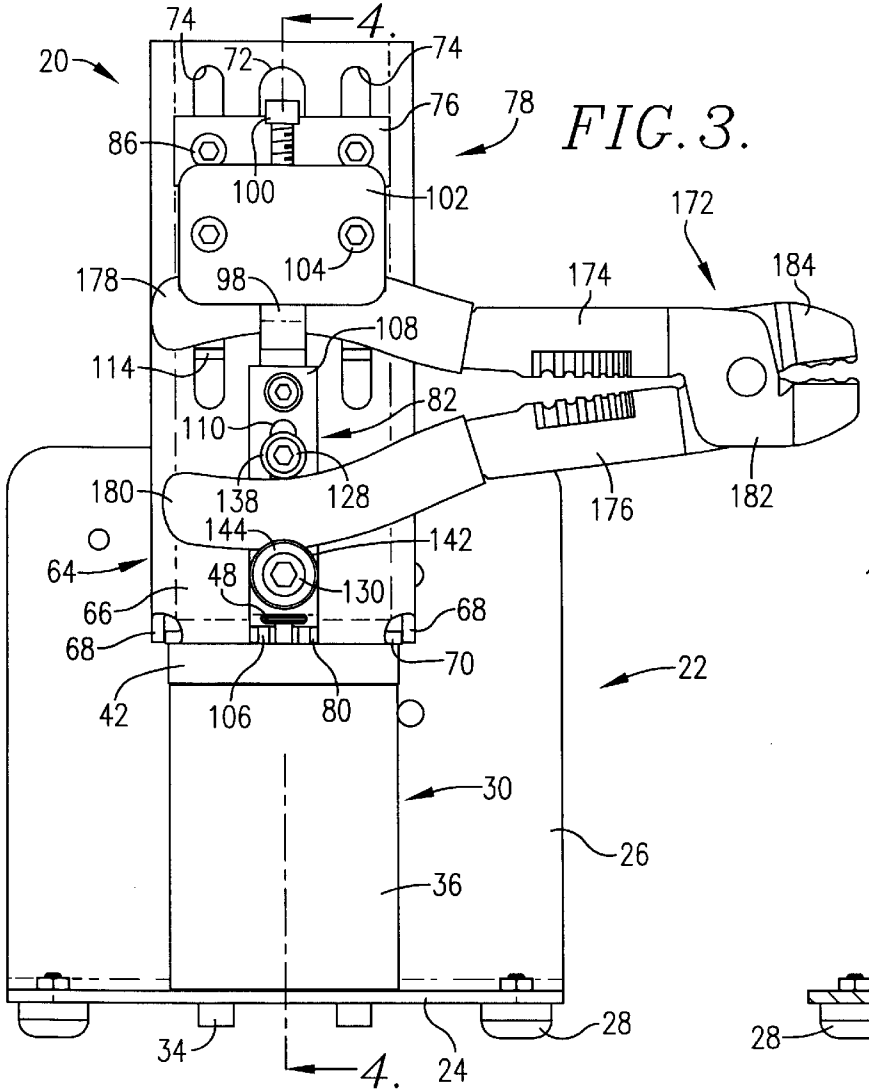
FIG. 3 is a front elevational view of the tool holding and actuating assembly, shown with a dual-leg tool supported thereby.
Figure 5:
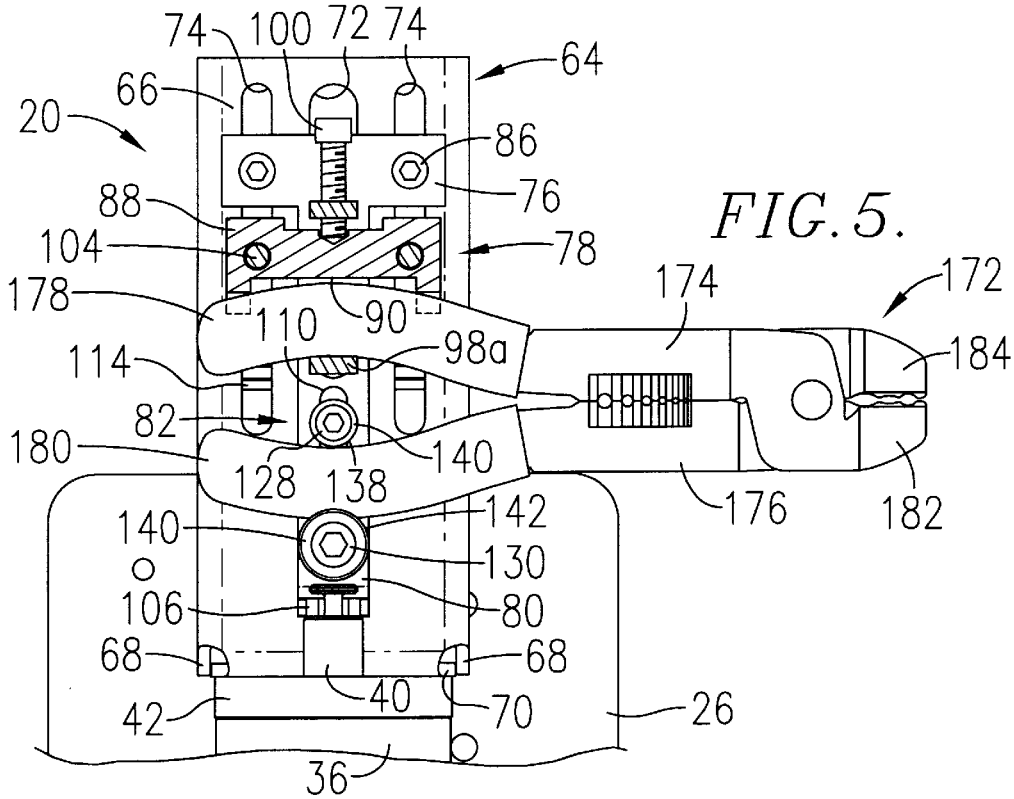
FIG. 5 is a fragmentary front view in partial vertical section depicting the tool holding and actuating assembly during operation thereof when the assembly is actuated so as to initiate a work operation by the tool.

As indicated previously, as the operator 80 is moved upwardly, the attached spring return plate 84 is also elevated. This serves to extend the springs 148 until the stroke limit of the piston rod 40 is reached. At this point, the delivery of pressurized air to the chamber 36 is terminate by releasing switch 14, and the tension within the springs 148 serves to move the plate 84 and operator 80 back to their original rest position depicted in FIGS. 3 and 4. Of course, during this sequence, the pressurized air within chamber 36 is exhausted through the three-way switch 14.

It will thus be appreciated that the invention provides a simple, economical holder and actuator unit for use with conventional, manually operable dual-leg tools, allowing a user to perform repetitive work operations on a succession of workpieces, simply by depressing a foot pedal.

I claim:

1. A power operated holder and actuator unit for supporting and actuating a manually operable leg tool having a pair of pivotally joined legs, with each of the legs having a manual manipulation end and an opposed work performing end, said unit comprising:

an integral holder operable to receive and hold the manipulating end of each of said tool legs in disposition orienting the opposed work ends of the legs in locations to receive and then perform a selected work operation on a workpiece placed therebetween, in response to relative movement between the manipulation ends of the tool legs and thereby the work performing ends of the tool legs; and a power actuator releasably supporting said holder thereon for removal and reattachment of said holder as a unit, said power actuator being operably connected to said holder in order to shift at least one of said manipulation ends of the legs of said tool toward the other opposed manipulation end of the tool legs thereof so as to perform said work operation on said workpiece, said holder including a first clamp for receiving and holding the manipulating end of one of the tool legs, and a second clamp for receiving and holding the manipulating end of the other tool leg, said power actuator having a component releasably coupled to said second clamp for shifting the manipulating end of said other tool leg toward and away from the manipulating end of said one tool leg.

2. A power operated holder and actuator unit as set forth in claim 1, wherein said power actuator includes reciprocal mechanism engageable with the second clamp for effecting essentially linear shifting of the second clamp and the manipulating end of said other tool leg received therein.

3. A power operated holder and actuator unit as set forth in claim 1, said holder including adjustable components for selectively changing the maximum open distance between the work ends of respective legs of the tool.

4. A power operated holder and actuator unit as set forth in claim 1, said first clamp being mounted for selective adjusting movement thereof in order to change the position of the manipulating end of one leg of the tool with respect to the manipulating end of the other leg of the tool.

5. A power operated holder and actuator unit as set forth in claim 1, said first clamp being mounted for selective adjusting movement thereof in order to change the maximum open distance between the work ends of respective legs of the tool.

6. A power operated holder and actuator unit as set forth in claim 1, said second clamp having at least one roller engaging said manipulating end of said other tool leg in order to permit sliding movement thereof along the manipulating end of said other tool leg upon shifting of the manipulating end of said other tool leg.

7. A power operated holder and actuator unit as set forth in claim 1, wherein said reciprocal mechanism comprises a piston and cylinder assembly having a shiftable piston rod, said piston rod operably coupled with said holder.

8. A power operated holder and actuator unit as set forth in claim 7, said piston and cylinder assembly being pneumatically operated.

9. A power operated holder and actuator unit as set forth in claim 7, including an adjustable stop on the holder which is oriented for limiting the stroke of said piston rod.

10. A power operated holder and actuator unit as set forth in claim 7, including a return spring on the holder which is operably coupled with said piston rod for return movement of the piston rod after shifting thereof to effect shifting of at least one of said manipulation ends of said tool.

11. A power operated holder and actuator unit as set forth in claim 1, said power actuator including an elongated reciprocal element engageable with said holder, the longitudinal axis of said element being transverse to said tool legs.

12. A poweroperated holder and actuator as set forth in claim 1, including a base plate having a frame support for the power actuator including two angularly-disposed legs, with the power actuator being selectively mounted on and supported by one of the frame legs, thus permitting positioning of the power actuator and thereby the holder at one of two different positions which are 90° with respect to one another.

13. A power operated holder and actuator as set forth in claim 12, wherein said power actuator is releasably and rotatably mounted on one of the legs of the frame.

* * * * *